US006814002B2

(12) United States Patent
Orimoto

(10) Patent No.: US 6,814,002 B2
(45) Date of Patent: Nov. 9, 2004

(54) PRINTING SYSTEM

(75) Inventor: Shinji Orimoto, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 17 days.

(21) Appl. No.: 09/796,377

(22) Filed: Feb. 28, 2001

(65) Prior Publication Data

US 2001/0018874 A1 Sep. 6, 2001

(30) Foreign Application Priority Data

Mar. 2, 2000 (JP) ..... 2000-056605

(51) Int. Cl.[7] ..... B41L 27/00
(52) U.S. Cl. ..... 101/335; 101/365; 101/484
(58) Field of Search ..... 101/335, 365, 101/484

(56) References Cited

U.S. PATENT DOCUMENTS 5,652,804 A * 7/1997 Bronstein et al. ..... 382/112
5,967,050 A * 10/1999 Seymour ..... 101/365
6,031,932 A * 2/2000 Bronstein et al. ..... 382/112
6,441,920 B1 * 8/2002 Smith ..... 358/1.2

FOREIGN PATENT DOCUMENTS

| | | |
|---|---|---|
| DE | 4328026 A1 | 3/1995 |
| JP | Sho-57-109389 | 6/1982 |
| JP | 10-151209 | 1/1998 |
| JP | 10-138571 | 5/1998 |
| JP | 10-125556 | 8/1998 |

OTHER PUBLICATIONS

Computer Translation of IDS document JP 11–314351 to Mitsubishi Heavy Ind. Ltd.*

* cited by examiner

*Primary Examiner*—Charles H. Nolan, Jr.
(74) *Attorney, Agent, or Firm*—Perkins Coie LLP

(57) ABSTRACT

A printing system includes an ink-amount control unit for controlling the amount of ink to be supplied to a printing press based upon an image area rate contained in a pre-press data, and at least one ink-amount calculation unit for calculating the image area rate. The ink-amount control unit is connected to the at least one ink-amount calculation unit on a network.

20 Claims, 3 Drawing Sheets

//PCS-H/inkdata2/,o.HD2
//IVS/ryobi/,r.IVS-1
//SV_050N/USER/,r.IVS-2
//SV_050N/SV570/,o.IVS-3
//CIP3-INK/,o.IVS-4

FIG. 2

```
//PCS-H/inkdata2/,o.HD2
//IVS/ryobi/,r.IVS-1
//SV_050N/USER/,r.IVS-2
//SV_050N/SV570/,o.IVS-3
//CIP3-INK/,o.IVS-4
```

PRINTING SYSTEM

BACKGROUND OF THE INVENTION

1. Field of the Invention

The present invention relates to a printing system that is capable of integrating an ink-amount control unit for controlling the amount of ink supplied to a printing press with an ink-amount calculation unit for calculating an image area rate contained in pre-press data or pre-press reproduction data.

2. Discussion of the Background

It has been heretofore known an ink-amount control unit of the type that is electrically connected to a printing press and is designed to adjust the opening degree of an ink fountain key in the printing press, thereby supplying an amount of ink adapted for the pre-press data to a roller train of the printing press.

In order to calculate the amount of ink supplied, an ink-amount calculation unit, which is designed to calculate the image area rate contained in the pre-press data such as those for the four-color process printing and the spot color process printing, is employed. This ink-amount control unit controls the opening degree of the ink fountain key in such a manner as to supply ink to the roller train of the printing press by an amount adapted for the image area rate calculated by the ink-amount calculation unit.

Since there exist various types of the pre-press data such as those of PS (postscript) type, and PPF (Print Production Format) type, several ink-amount calculation units need to be set up to cope with these different types of data in some cases.

However, the above conventional arrangement may cause a trouble in controlling the amount of ink supplied, since the ink-amount control unit is electrically separated from the ink-amount calculation unit. Specifically, the above arrangement poses a problem of causing troublesome works such as those for transferring data representative of the image area rate calculated by the ink-amount calculation unit in a floppy disc, carrying the floppy disc to an installation site of the ink-amount control unit, and reading the data from the floppy disc.

Particularly, when the ink-amount control unit is to be set up at a place far from the ink-amount calculation unit due to a limited installation space, the operation of both units may further deteriorate the workability for performing various works as described above. In addition, when several ink-amount calculation units are set up at different places, the operator needs to walk among the ink-amount calculation units, which is time-consuming and deteriorates the maintenance performance. Also, there remains a possibility of damaging a floppy disc or any other external memory devices.

It is an object of the present invention to provide a printing system that provides ease of control enabling the operator to easily control the amount of ink to be supplied to the printing press based upon the image area rate contained in the pre-press data, and provides improved maintenance performance.

SUMMARY OF THE INVENTION

According to the present invention, there is provided a printing system that includes an ink-amount control unit for controlling the amount of ink to be supplied to a printing press based upon an image area rate contained in a pre-press data, and at least one ink-amount calculation unit for calculating the image area rate. The ink-amount control unit is connected to the at least one ink-amount calculation unit on a network.

The above arrangement with the ink-amount control unit and the at least one ink-amount calculation unit connected thereto on the network can omit the necessity of using an external memory device such as a floppy disc for distribution of the data between the units, so that the amount of ink to be supplied to the printing press can easily be controlled based upon the image area rate calculated by the at least one ink-amount calculation unit. In addition, the network connection provides ease of system administration and improved maintenance performance.

The above printing system preferably has an arrangement that the ink amount control unit creates a file therein, and the file rewritably stores the names of units connected on the network, which units including the ink-amount control unit and the at least one ink-amount calculation unit, and the names of folders created in the units connected on the network, each of the folders storing data representative of the image area rate. The ink-amount control unit refers to the file, and selects a corresponding data representative of the image area rate to be used for controlling the amount of ink to be supplied to the printing press.

According to the above arrangement, a proper image area rate data to be used for controlling the amount of ink can securely be selected by the reference to the file. In addition, storage of the names of the units, e.g., ink-amount calculation unit, ink-amount control unit or any other units, and the names of the folders created in the units can omit the possibility of unintentionally selecting an image area rate data which is not to be used. As another excellent advantage, an additional ink-amount calculation unit can easily be set up with connection to the other units on the network by editing the content of the file, or adding, changing, deleting or modifying a unit name in the file.

Preferably, the at least one ink-amount calculation unit comprises a computer having a keyboard as an information input means; and the file has a content rewritable via the at least one ink-amount calculation unit. With this arrangement, the content of the file can easily be rewritten by the keyboard of the at least one ink-amount calculation unit, unlike the conventional arrangement. Specifically, it is hard to edit the file via the ink-amount control unit, which is usually provided with a touch panel as an input means.

The ink-amount calculation unit is preferably provided with a display means for displaying information indicative of a corresponding position or order of the selected image area rate data with respect to an entire data group stored in the file. This display means improves an visual observation performance for the operator, since a corresponding position of the selected image area rate with respect to an entire data group in the file is properly displayed. As a result, a possibility of unintentionally selecting an incorrect data can be limited.

BRIEF DESCRIPTION OF THE DRAWINGS

FIG. 2 illustrates an example of contents of a file created in the ink-amount control unit of FIG. 1.

DETAILED DESCRIPTION OF THE PREFERRED EMBODIMENT

Figure 1:
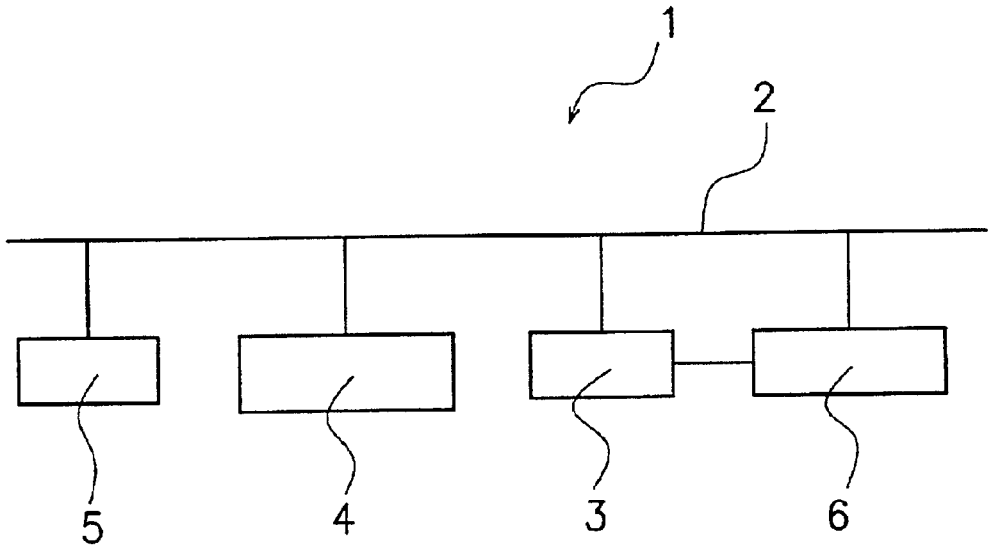
FIG. 1 is a schematic diagram representative of a printing system according to one embodiment of the present invention.

An embodiment of the present invention will be hereinafter described with reference to the drawings attached hereto. FIG. 1 a schematic diagram representative of a printing system according to one embodiment of the present invention. As illustrated in this Figure, the printing system of this embodiment includes an ink-amount control unit 3 and an ink-amount calculation unit 4 connected thereto on a network 2. In the system, a maintenance computer 5 is also connected to the network 2 for the maintenance of the network 2.

The ink-amount control unit 3 is a single-purpose machine equipped with a touch panel and connected to the printing press 6, and is designed to control the amount of ink to be supplied to the printing press 6, or control the opening degree of an ink fountain key of the printing press 6 based upon an image area rate contained in a hereinafter described pre-press data.

The ink-amount calculation unit 4 is constituted by a general-purpose personal computer, on which a software designed for calculation of the ink amount is installed to calculate the image area rate contained in the pre-press data. The data representative of the image area rate calculated by the ink-amount calculation unit 4 can readily be read out at the ink-amount control unit 3 via the network, so that the amount of ink to be supplied to the printing press 6 is controllable to a value adapted to the data.

The data representative of the image area rate calculated by the ink-amount calculation unit 4 is stored in a predetermined folder on a hard disc (H/D) of the ink-amount calculation unit 4. In this regard, it is possible to copy the calculated image area rate data onto a predetermined folder on an H/I of the ink-amount control unit 3 via the network 2. It is also possible to store the data on an H/D of the maintenance computer 5, if needed.

In the embodiment of FIG. 1, one ink-amount calculation unit 4 is connected to the network 2. However, the present invention is not limited to this arrangement. Specifically, it is possible to connect several ink-amount calculation units 4 to the network so as to cope with different types of pre-press data such as those of PS (postscript) type and PPF (Print Production Format) type from which image area rates are respectively calculated. In addition, even if the data of the same type is used in a printing operation, it is possible to connect several ink-amount calculation units to the network 2 for a specific operational condition.

The names of the units and the names of the folders, in which respective image area rate data are stored, are then stored in a file created on the H/D of the ink-amount control unit 3. The ink-amount control unit 3 refers to the file so as to select an image area rate data to be used for controlling the amount of ink supplied to the printing press 6.

FIG. 2 illustrates one example of the contents of the file, which example is designed for the printing system in which one ink-amount control unit 3 (Name: PCS-H) and three ink-amount calculation units (Names: IVS, SV_050N, CIP3) 4 are connected to the network 2, and each have the HID creating a predetermined folder in which an image area rate data is stored.

As illustrated in FIG. 2, the file stores the unit names (e.g., PCS-H) and the folder names (e.g., inkdata2), which are respectively indicative of the units and the folders with the image area rate data stored therein. Storage of the unit names and the folder names in the file can thus omit the possibility of unintentionally selecting an image area rate data which is not to be used.

Figure 3:
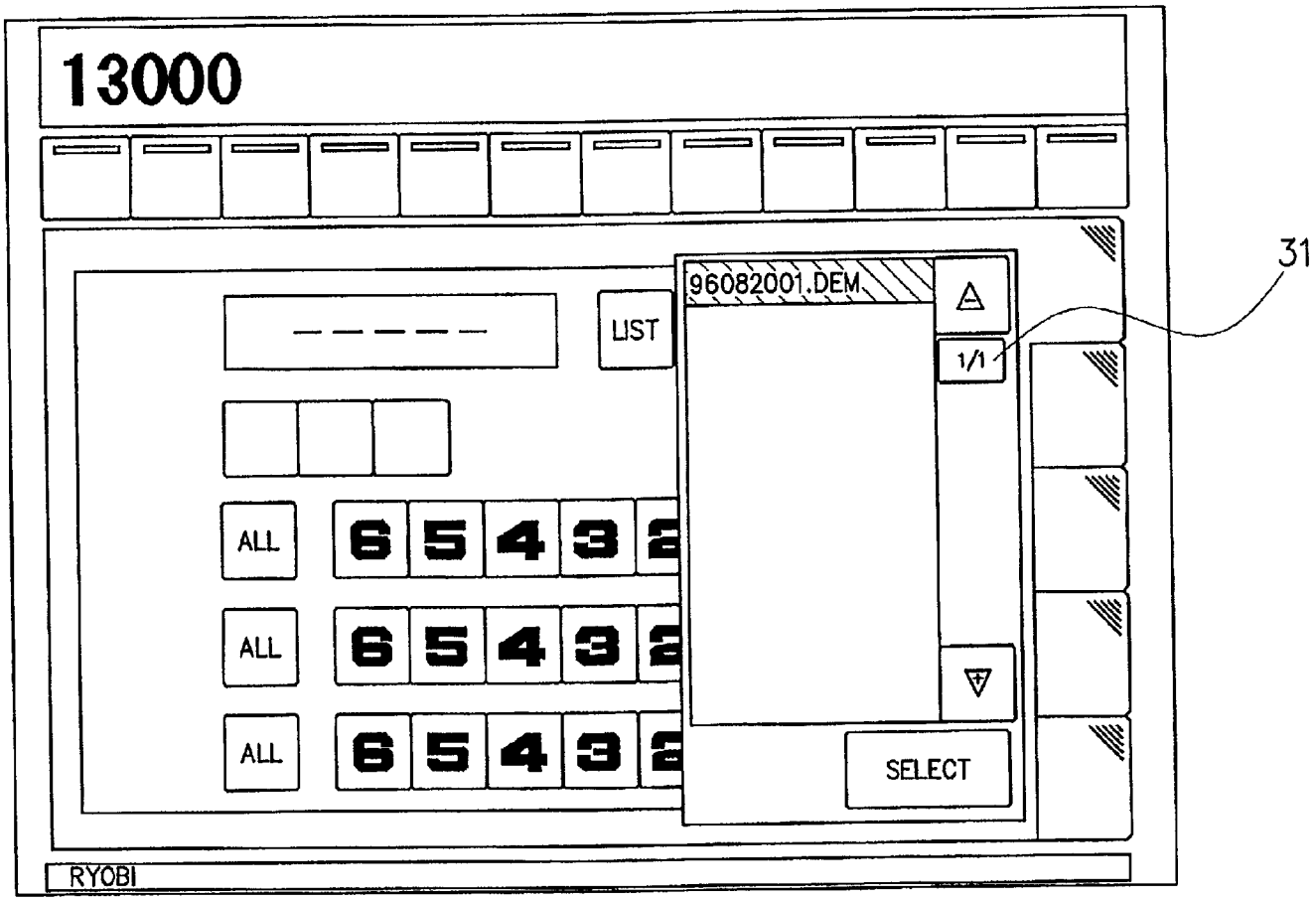
FIG. 3 is an example of display variations of a monitor screen.

The above arrangement requires the operator only to select the names of the target unit and target folder among various names of the units and the folders registered in the file, via the touch panel of the ink-amount control unit 3. FIG. 3 illustrates one example of display variations of a monitor screen provided on the ink-amount control unit 3. As illustrated in this Figure, the monitor screen is provided with a display area 31 which displays a numerical code indicative of a corresponding position or order of the selected image area rate data with respect to an entire data group stored in the file, or indicative of the information as to where the selected image area rate data is positioned in the entire data group. The numerical code displaying area is an area with hatching in FIG. 3, in which the data is shown in the form of: corresponding position/total number of the stored data. In this Figure, the display indicates: 1/1, which means the total number of the stored data is one. This display improves a visual observation performance for the operator and hence limits a possibility of unintentionally selecting an incorrect image area rate data.

Once the operator selects the names of the target unit and target folder, the ink-amount control unit 3 accesses to a site or file, where the target image area rate data presents, via the network 2, and then read out the data to control the amount of ink supplied. Alternative to the arrangement in this embodiment, which involves the manual selection of the unit name and the folder name by the operator, it is also possible to employ the arrangement that the names of the units and the folders are sequentially selected and read out from the file in an automatic manner.

The file is designed to store the data in a rewritable manner. Therefore, the content of the file can freely be edited so as to easily and fully meet various requirements such as to change the data storing folder for certain reasons and connect an additional ink-amount calculation unit to the network. The edition of the content of the file can very easily be performed by using a keyboard of the ink-amount calculation unit 4 in the same manner as that for edition a common text file.

As described above, according to the printing system of the present invention, the connection of the ink-amount control unit and the ink-amount calculation unit on the network omits the necessity of using an external memory device such as a floppy disc for distribution of the data between the units, so that the amount of ink to be supplied to the printing press can easily be controlled based upon the image area rate calculated by the ink-amount calculation unit. In addition, the network connection provides ease of system administration and improved maintenance performance.

The ink-amount control unit may also be designed so that it creates a file which stores the unit names indicative of the units connected to the network and the folder names indicative of the folders respectively storing the image area rate data in a rewritable manner, refers to the file, and selects a proper image area rate data to be used for controlling the amount of ink supplied to the printing press.

According to the above arrangement, a proper image area rate data to be used for controlling the amount of ink can securely be selected by the reference to the file. In addition, storage of the names of the units, e.g., ink-amount calculation unit, ink-amount control unit or any other units, and the names of the folders in the units can thus omit the possibility of unintentionally selecting an image area rate data which is not to be used. As another excellent advantage, an additional ink-amount calculation unit can easily be set up with connection to the network by editing the content of the file, or adding, changing, deleting or modifying a unit name in the file.

This specification is by no means intended to restrict the present invention to the preferred embodiments set forth therein. Various modifications to the printing system, as described herein, may be made by those skilled in the art without departing from the spirit and scope of the present invention as defined in the appended claims.

What is claimed is:

1. A printing system comprising an ink-amount control unit for controlling the amount of ink to be supplied to a printing press based upon an image area rate contained in a pre-press data, and at least one ink-amount calculation unit for calculating said image area rate, wherein:

said ink-amount control unit is connected to said at least one ink-amount calculation unit on a network;

said ink amount control unit creates a file therein;

said file being for rewritably storing system data including the names of units connected on the network, said units including said ink-amount control unit and said at least one ink-amount calculation unit, and said system data including the names of folders created in said units connected on the network, each of said folders storing data representative of said image area rate;

said ink-amount control unit refers to said file, and selects a corresponding data representative of said image data area rate to be used for controlling the amount of ink to be supplied to the printing press.

2. A printing system according to claim 1, wherein:

said at least one ink-amount calculation unit comprises a computer having a keyboard as an information input means; and said file has a content rewritable via said at least one ink-amount calculation unit.

3. A printing system according to any one of claims 1 and 2, wherein:

said ink-amount calculation unit is provided with a display means for displaying information indicative of a corresponding position of the selected image area rate data with respect to an entire data group stored in the file.

4. A method for controlling the amount of ink supplied to at least one printing press over a network connected to at least one ink calculation module, wherein said at least one ink calculation module communicates with at least one ink control unit via a network, each of said at least one ink control unit having local data storage and controlling the amount of ink supplied to a printing press, comprising the steps of:

assigning an indicator to at least one data set including image area rate data, said indicator including at least an identifier;

storing said at least one data set in a predetermined storage location on at least one ink calculation module, wherein said at least one data set becomes available over said network after being stored;

displaying a list of all data sets available over said network on a display of a target control unit of said at least one control unit;

selecting a target data set from all data sets available over said network with said target control unit; and allowing said target data set to be accessed by said target control unit through said network, such that said printing press may be controlled by said target data wherein said identifier indicates one of said at least one control units or one of at least one calculation modules.

5. The method as recited in claim 4, further comprising the act of storing said target data set on said local data storage of said target control unit.

6. The method as recited in claim 5, wherein the act of storing said target data set on said local storage of said target control unit changes said identifier associated with said target data set.

7. The method as recited in claim 4, wherein there are a plurality of said at least one ink calculation modules, such that each of said calculation modules may be activated by a specific operational condition.

8. The method as recited in claim 4, wherein there are plurality of one said at least one ink calculation modules, such that each of said calculation modules may will be activated by a specific type of data set.

9. The method as recited in claim 4, wherein there are a plurality of at least one ink calculation modules, and at least two of said plurality of ink calculation modules are located on the same computer.

10. The method as recited in claim 4, wherein there are a plurality of said at least one ink calculation modules, and said plurality of ink calculation modules are each located on a different computer.

11. The method as recited in claim 4, further comprising the step of not allowing said target ink control unit to control said printing press with said selected target data set.

12. The method as recited in claim 4, wherein the act of displaying includes providing a numerical code corresponding to a position of each of said data sets available over said network with respect to the all the data stored over said network said position being physical, chronological, or heirarchical.

13. The method as recited in claim 4, wherein the act of displaying includes providing a numerical code corresponding to a position of each of data sets available with respect to the all the data stored in said predetermined locations or on said target ink control unit.

14. The method as recited in claim 4, wherein said indicator assigned to said target data set is edited.

15. The method as recited in claim 14, wherein said editing is activated by a set of conditions detected over said network wherein said set of conditions includes said target set being accessed.

16. The method as recited in claim 4, wherein a set of access restrictions may be entered into one of said at least one calculation units such that said target ink control unit may not select one or more of said at least one data set available over a network.

17. The method as recited in claim 4, comprising the act of evaluating said target data set.

18. The method as recited in claim 17, further including the act of adding a new data set based on the results from said evaluation step.

19. The method as recited in claim 18, wherein said act of adding said new data set includes assigning a new said new set of data without changing said image area rate included in said target data set.

20. The method recited in claim 4, wherein each respective said at least one ink calculation module has said predetermined storage location.

* * * * *